US010213083B2

(12) United States Patent
Buddeker et al.

(10) Patent No.: US 10,213,083 B2
(45) Date of Patent: Feb. 26, 2019

(54) URBAN OR INDUSTRIAL VACUUM CLEANER

(71) Applicant: LANGE CHRISTIAN SA, Andenne (BE)

(72) Inventors: Franck Buddeker, Flemalle (BE); Jean-Benoît Langouche, Comblain-au-Pont (BE); Christian Lange, Ohey (BE)

(73) Assignee: LANGE CHRISTIAN SA, Andenne (BE)

( * ) Notice: Subject to any disclaimer, the term of this patent is extended or adjusted under 35 U.S.C. 154(b) by 0 days.

(21) Appl. No.: 15/506,124

(22) PCT Filed: Aug. 25, 2015

(86) PCT No.: PCT/EP2015/069450
§ 371 (c)(1),
(2) Date: Feb. 23, 2017

(87) PCT Pub. No.: WO2016/030377
PCT Pub. Date: Mar. 3, 2016

(65) Prior Publication Data

US 2018/0092501 A1 Apr. 5, 2018

(30) Foreign Application Priority Data

Aug. 26, 2014 (FR) ..... 14 01902

(51) Int. Cl.
*A47L 11/40* (2006.01)

(52) U.S. Cl.
CPC ..... *A47L 11/4061* (2013.01); *A47L 11/4066* (2013.01); *A47L 11/4075* (2013.01)

(58) Field of Classification Search
CPC ..... A47L 11/4061; A47L 11/4066; A47L 11/4075; A47L 9/009; A47L 9/325; A47L 5/28; A47L 2201/00
See application file for complete search history.

(56) References Cited

U.S. PATENT DOCUMENTS 4,009,908 A * 3/1977 Alinder ..... E04G 23/006 15/93.1
4,499,624 A * 2/1985 Bloome ..... A47L 11/185 15/230
6,629,333 B2 * 10/2003 Bolden ..... A47L 7/0028 15/383

FOREIGN PATENT DOCUMENTS

DE 10 2007 025 764 B3 7/2008
FR 2 587 740 A1 3/1987
(Continued)

*Primary Examiner* — Dung Van Nguyen
(74) *Attorney, Agent, or Firm* — Reinhart Boerner Van Deuren P.C.

(57) ABSTRACT

The present invention relates to a street or industrial vacuum cleaner (1) on a chassis (50) and self-propelled using at least one drive motor comprising a guide element preferably taking the form of a handlebar (70) with at least one handle (740), a hand grip (730) and means or elements (710) for attachment to the chassis (50) of the vacuum cleaner (1), said attachment means or elements (710) making it possible, by the transmission of the movement applied to the hand grip (730), to steer said vacuum cleaner (1), characterized in that the handle (740) comprises a telescopic zone with a sliding part (745) able to move between a first position referred to as an extended position and a second position referred to as a retracted position, preferably with a return spring (780) and at least a switch (770) for detecting the position of the sliding part (745), said switch (770) being
(Continued)

able to cause the street vacuum cleaner drive motor to switch off or reverse if the sliding part (745) is in the retracted position.

12 Claims, 7 Drawing Sheets

(56) References Cited

FOREIGN PATENT DOCUMENTS

| | | | |
|---|---|---|---|
| WO | WO 2013/064182 | A1 | 5/2013 |
| WO | WO 2014/108694 | A1 | 7/2014 |

* cited by examiner

URBAN OR INDUSTRIAL VACUUM CLEANER

SUBJECT MATTER OF THE INVENTION

The present invention relates to apparatuses (preferably self-propelled) with a combustion engine or electric motor that make it possible to vacuum up all types of urban or industrial waste, typically called urban or industrial vacuum cleaners.

More particularly, the present invention relates to a device performing the function, and more generally assuming the form, of a guiding element, and in particular a handlebar.

Technological Background and Problems to be Solved

Self-propelled apparatuses used as urban or industrial vacuum cleaners have existed for several decades.

They are essentially used by sanitation agents to clean urban, industrial and/or recreational sites. Major improvements have been made to this type of apparatus.

In particular, combustion engines have been replaced by electric motors, coupled or not to batteries, which are quieter and also make it possible to separate the propulsion from the vacuuming functions. These apparatuses have an autonomy ranging from several hours to several days.

These apparatuses are currently equipped with a guiding element more generally called "handlebar", which assumes the form of a relatively long shaft and a hand grip in order to allow good grasping. The hand grip can be a so-called "closed" or "open" hand grip. The guiding element or handlebar allows the control of the direction of the self-propelled apparatus used as an urban vacuum cleaner through gear and transmission elements.

However, as this type of apparatus is generally self-propelled, a risk remains of the apparatus continuing to move when the user is no longer present alongside it. In this respect, various safety systems have been provided, such as a bracelet to be attached to the user's wrist, capable of break the contact by pulling out if the user falls, a hand grip to be held constantly and that breaks contact when it is released, or a presence detector that stops the machine in case of absence.

Another risk with this type of apparatus is that, during use, if the user collides with an unexpected obstacle, he may be crushed by the apparatus, which continues to move forward, this type of apparatus weighing up to 450 kg, or even more for some models. To prevent this, a so-called "dead man" hand grip may be provided on the guiding element that makes it possible, when the hand grip is released, for the machine to shut off automatically. This type of safety already exists on some apparatuses, for example on lawnmowers.

However, in the particular case where a user moves backwards and collides with a wall, or more generally with a vertical element or panel, even this type of safety may prove insufficient, with the risk of the user being crushed against this element or this vertical barrier.

Document FR2587740 describes a mechanical soil stripping machine with manual control and comprising a drawbar that may serve as a partially retractable control stick. On this type of machine, providing an anti-crushing mechanism is not considered.

The present invention aims to propose a solution that makes it possible to solve these various problems by proposing a guiding element, and in particular a handlebar, that makes it possible to avoid any crushing of the user by allowing either the stopping or the reversal of the motor of the urban vacuum cleaner.

SUMMARY OF THE INVENTION

The present invention relates to a urban or industrial vacuum cleaner on a chassis and self-propelled by at least one driving motor, comprising a guiding element preferably (or substantially) taking the form of a handlebar with at least a shaft, a hand grip and means or elements for attachment to the chassis of the vacuum cleaner, said attachment means or elements enabling, by the transmission of the movement applied to the hand grip, to steer said vacuum cleaner, said vacuum cleaner being characterized in that the shaft comprises a telescoping zone with a sliding part able to move (slide) between a first so-called extended position and a second so-called retracted position, preferably with a return spring and at least one switch for detecting the position of the sliding part.

The present invention relates to a urban or industrial vacuum cleaner on a chassis and self-propelled by at least one driving motor comprising a guiding element preferably (or substantially) taking the form of a handlebar with at least a shaft, a hand grip and means or elements for attachment to the chassis of the vacuum cleaner, said attachment means or elements enabling, by the transmission of the movement applied to the hand grip, to steer said vacuum cleaner, said vacuum cleaner being characterized in that the shaft comprises a telescoping zone with a sliding part able to move (slide) between a first so-called extended position and a second so-called retracted position, preferably with a return spring and at least one switch for detecting the position of the sliding part, said switch being able to cause the driving motor of the urban vacuum cleaner to switch off or reverse if the sliding part is in the retracted position.

More specifically, the present invention relates to a urban or industrial vacuum cleaner on a chassis and self-propelled by at least one driving motor comprising a guiding element preferably (or substantially) taking the form of a handlebar with at least one shaft, a hand grip and means or elements for attachment to the chassis of the vacuum cleaner, said attachment means or element enabling, by the transmission of the movement applied to the hand grip, to steer said vacuum cleaner, said vacuum cleaner being characterized in that the shaft comprises a telescoping zone with a sliding part able to move (slide) between a first so-called extended position and a second so-called retracted position, preferably with a return spring and at least one switch for detecting the position of the sliding part, said switch being able to command the urban vacuum cleaner driving motor to switch off or reverse if the sliding part is in the retracted position.

Preferably, said urban or industrial vacuum cleaner is such that the travel of the sliding or telescoping part is of at least 80 mm, preferably at least 100 mm, preferably at least 150 mm.

Preferably, the spring return force to be applied is comprised between 100 and 200 N, and preferably close to 150 N.

Preferably, the return spring is configured so as to return said sliding part of the shaft to the extended position as soon as no force is exerted on the hand grip.

Preferably, the return spring is configured to be positioned in a retracted position as soon as a force is applied on said hand grip of the guiding element.

Preferably, in the urban or industrial vacuum cleaner according to the present invention, the sliding or telescoping part has at least two shaft parts provided with sliding rings via which the one shaft part can be inserted in the other and via which the shaft parts can move (slide) relative to one another.

Preferably, the length of each of said shaft parts is substantially equivalent to and at least more than half of the total length of the shaft.

Preferably, the detection switch is able to send a signal, preferably electrical or optical, as soon as the shaft is no longer in its extended position.

Preferably, the detection switch comprises a mechanical part that will move and come into contact with an electrical part as soon as the sliding part (at the telescoping zone) moves relative to the stationary part of the shaft of the guiding element.

Preferably, the detection switch comprises an optical part that will move and come into contact with an electrical part as soon as the sliding part moves relative to the stationary part of the shaft of the guiding element.

DETAILED DESCRIPTION OF THE INVENTION

The present invention will be described in more detail in one or several preferred embodiments of the invention in reference to the appended figures and in which the elements or details may be combined or omitted. The same is true regarding a combination of details shown in the figures that represent the state of the art with the essential elements of the present invention.

Figure 1:
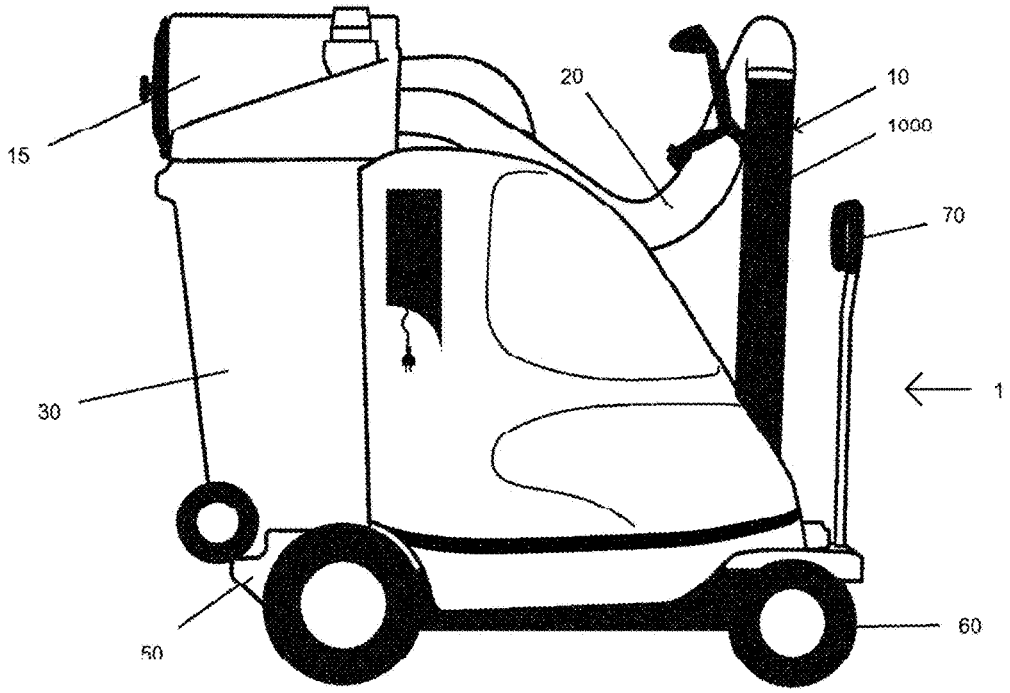
FIG. 1 shows an apparatus used as an urban or industrial vacuum cleaner as currently used according to the state of the art, but also able to be used according to the present invention.

FIG. 1 shows a general view of an urban or industrial vacuum cleaner that is simply illustrated by reference 1 and is provided with a device serving as a vacuuming tube 10.

Motors (not shown) allow the vacuuming and the mobility of the vacuum cleaner 1. The motors can be made up either of one or several combustion engines, or one or several electric motors.

Particularly advantageously, electric motors are currently favored due to their low noise annoyance. More particularly, still more advantageously, it is possible to consider the presence of two electric motors, one being directly dedicated to the mobility of the vacuum cleaner, the other being dedicated to the vacuuming capacity. Of course, if electric motors are used, batteries must be provided that allow an autonomy of several hours, and if possible 6 to 8 hours, with a relatively short recharging time.

A waste collection container 30 and a filter 15 are positioned on a chassis 50 provided with locomotive means 60. The chassis 50 is traditionally a mechanically welded chassis, optionally made from steel or stainless steel. It is also possible to consider an aluminum chassis.

A guiding element substantially taking the form of a handlebar 70 serves as a control arm for steering the urban or industrial vacuum cleaner apparatus 1.

Figure 2:
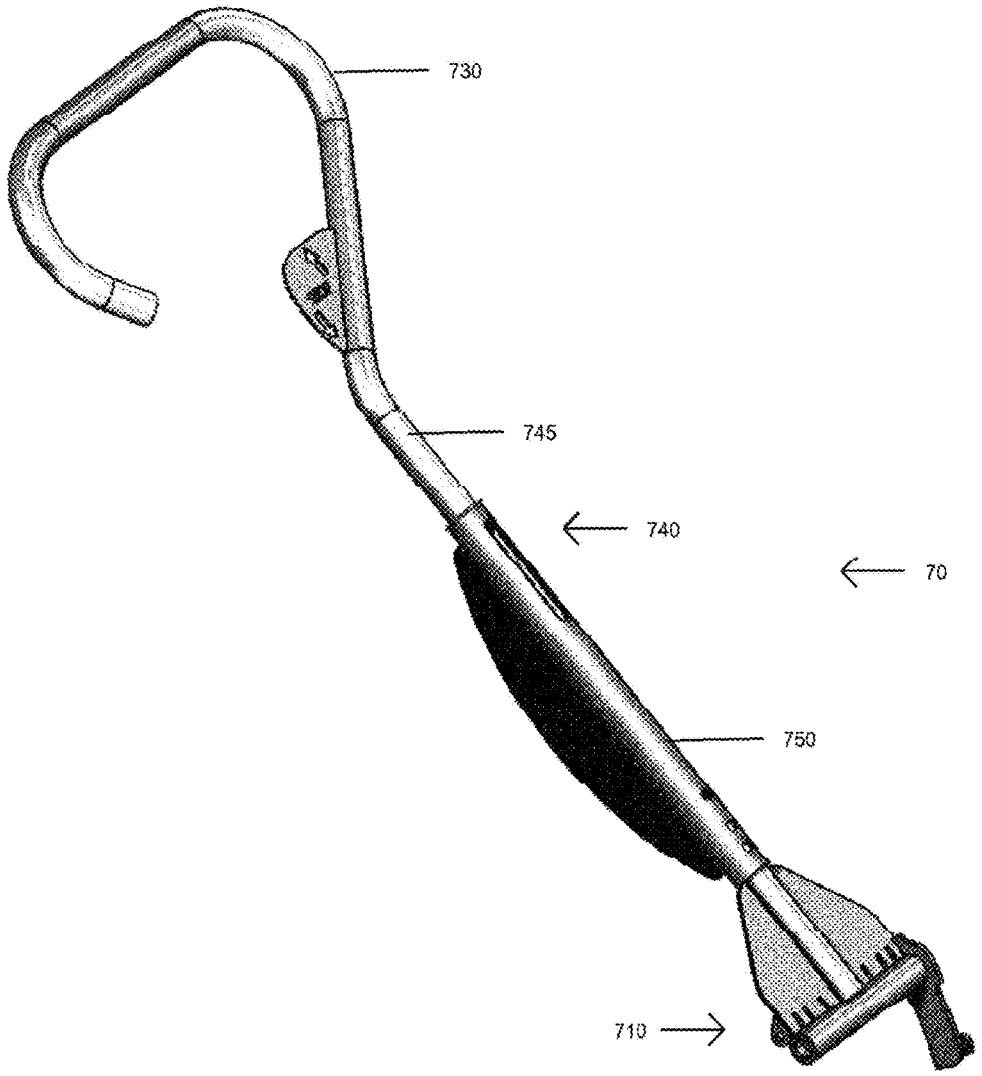
FIGS. 2 and 3 show an embodiment of a guiding element as it may be used according to the present invention in the "idle or extended" position (FIG. 2) or the "active or retracted" position (FIG. 3).
Figure 3:
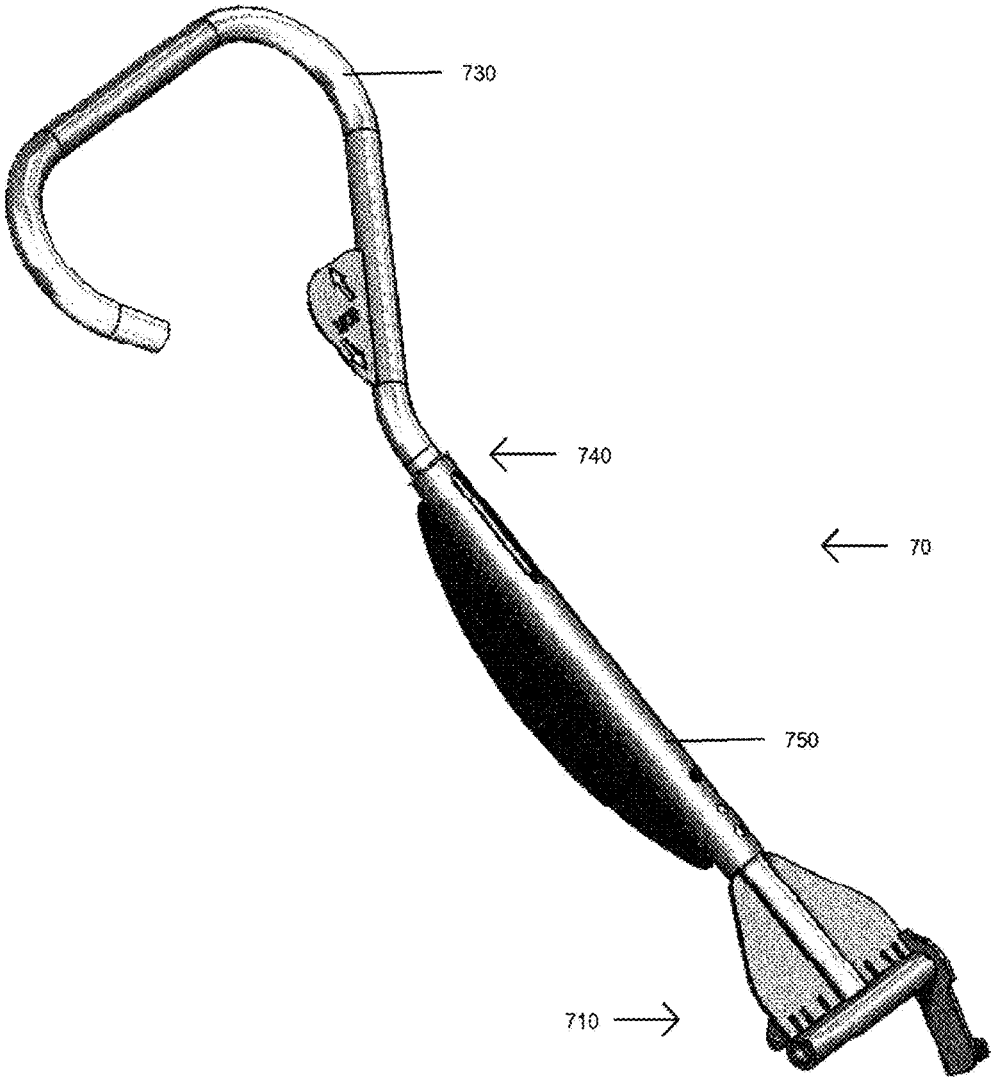

FIGS. 2 and 3 show this guiding element 70 separated from the urban or industrial vacuum cleaner apparatus. The guiding element as shown in FIG. 2 traditionally comprises attachment means 710 to said urban or industrial vacuum cleaner apparatus and more particularly to the chassis 50. Said guiding element 70 traditionally has a shaft 740 and a hand grip 730. The movement imparted to the hand grip 730 will be transmitted via the shaft 740 and the attachment means 710 of the self-propelled apparatus used as an urban or industrial vacuum cleaner 1. This shaft therefore allows to control the movement of said apparatus. Of course, control means can be provided on the hand grip 730 in order to switch off or reverse the movement of said urban or industrial vacuum cleaner 1 at any time.

Figure 4:
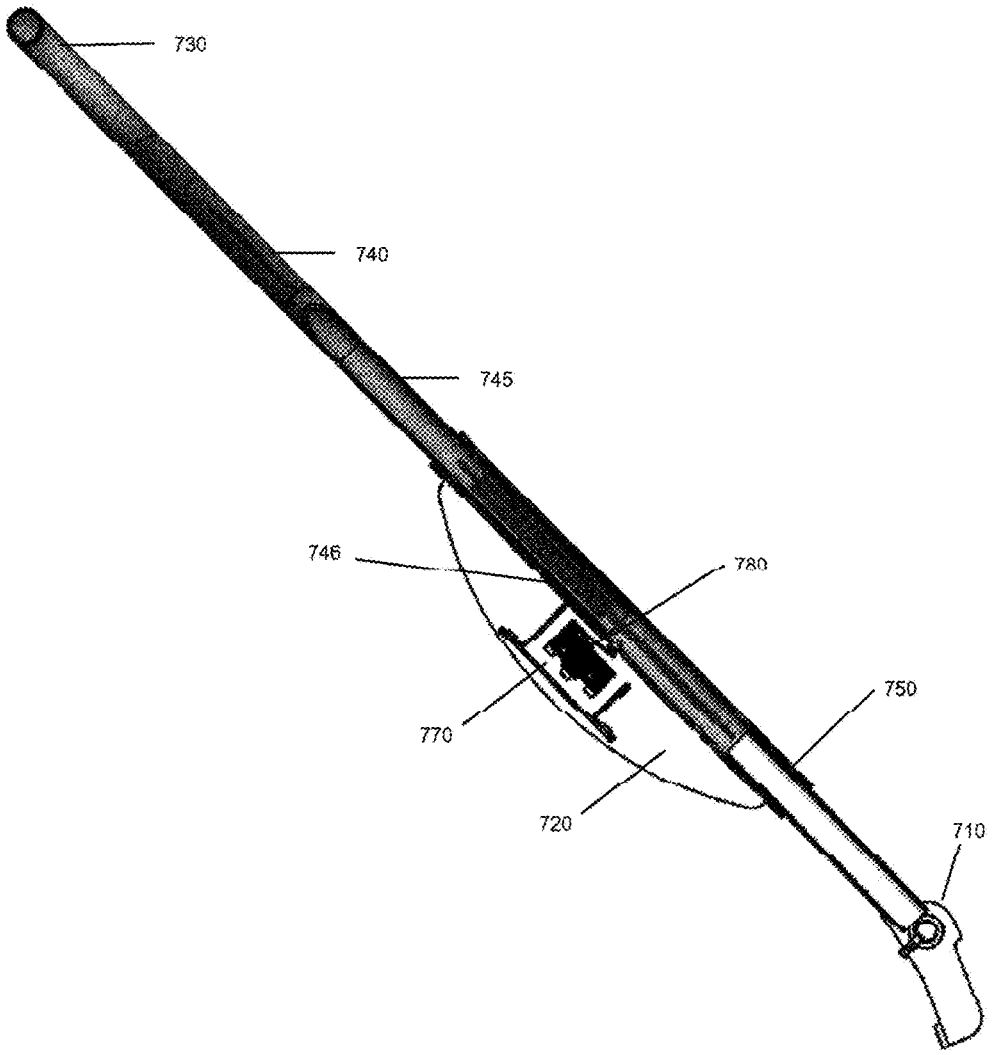
FIGS. 4 and 5 show sectional views of the guiding element on the one hand as a whole, on the other hand in more detail according to a preferred embodiment of the invention, with the main constituent elements.

According to the present invention, a telescoping zone is provided on the shaft 740, said zone being made up of a first so-called sliding or moving part 745 of the shaft that moves relative to a so-called stationary part 750 of the shaft. FIG. 2 corresponds to a state of the guiding element in which the shaft 740 is idle (extended), with the telescoping zone, and therefore the sliding part, in the idle (extended) position, while FIG. 3 corresponds to a state of the guiding element in which the shaft 740 is retracted, with the telescoping zone, and therefore the sliding part, in the retracted position. Ideally, the dimensions of the shaft tubes of the sliding 745 and stationary 750 parts are such that they allow one shaft tube to be inserted in the other via sliding rings 746 and the movement of one part relative to the other as illustrated in FIG. 4.

Ideally, the travel of the sliding part 745 at the telescoping zone, inside or outside the stationary part 750, is of at least 80 mm, preferably at least 100 mm, preferably at least 150 mm.

The sliding part 745 is able to move relative to the stationary part as soon as a force greater than 50 N, preferably 100 N, preferably close to 150 N is applied on the hand grip 730; if the user of the vacuum cleaner backs up against an unexpected obstacle, this makes it possible to generate an immediate, practically instantaneous movement of the apparatus so as to prevent it from abutting against said obstacle.

To that end, the handlebar is provided with a switch 770 for detecting movement of the sliding part 745 relative to the stationary part 750. Thus, practically simultaneously, concretely depending on the response time of the detection switch 770, the switch off or reversing of the driving motor of the vacuum cleaner is controlled. This detection switch or interrupter 770 is described in more detail in FIG. 5.

Figure 5:
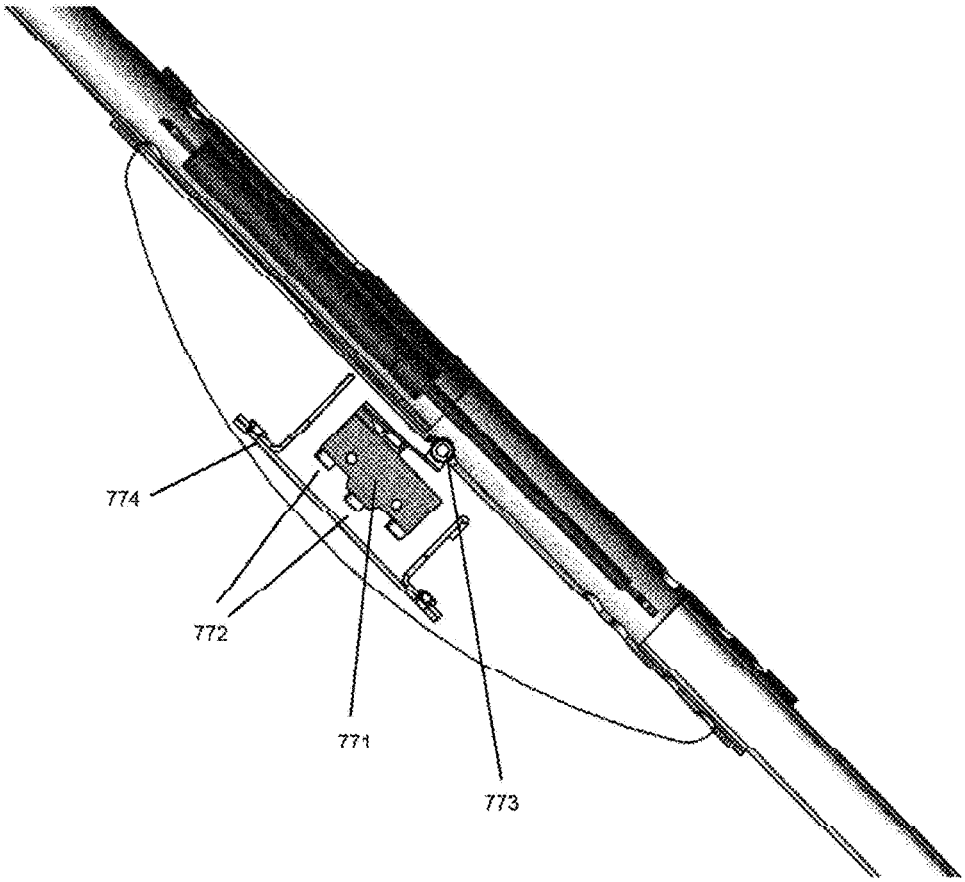

According to the embodiment shown in FIG. 5, the switch 770 is present on a so-called switch support 720. Said switch 770 comprises a mechanical part 771 able to detect the movement (the position) of the sliding part 745 relative to the stationary part 750, for example using a wheel or roller 773 (or any other equivalent means capable of sliding) that moves during the movement of the sliding part 745. The mechanical part 771 can then come into contact with a stop element 772, which is preferably conductive, which in turn comes into contact with an electrical part 774. Said electrical part 774 can then directly emit an electrical signal in order to command the driving motor of the apparatus 1 to switch off or reverse, in the traditional manner.

Figure 6:
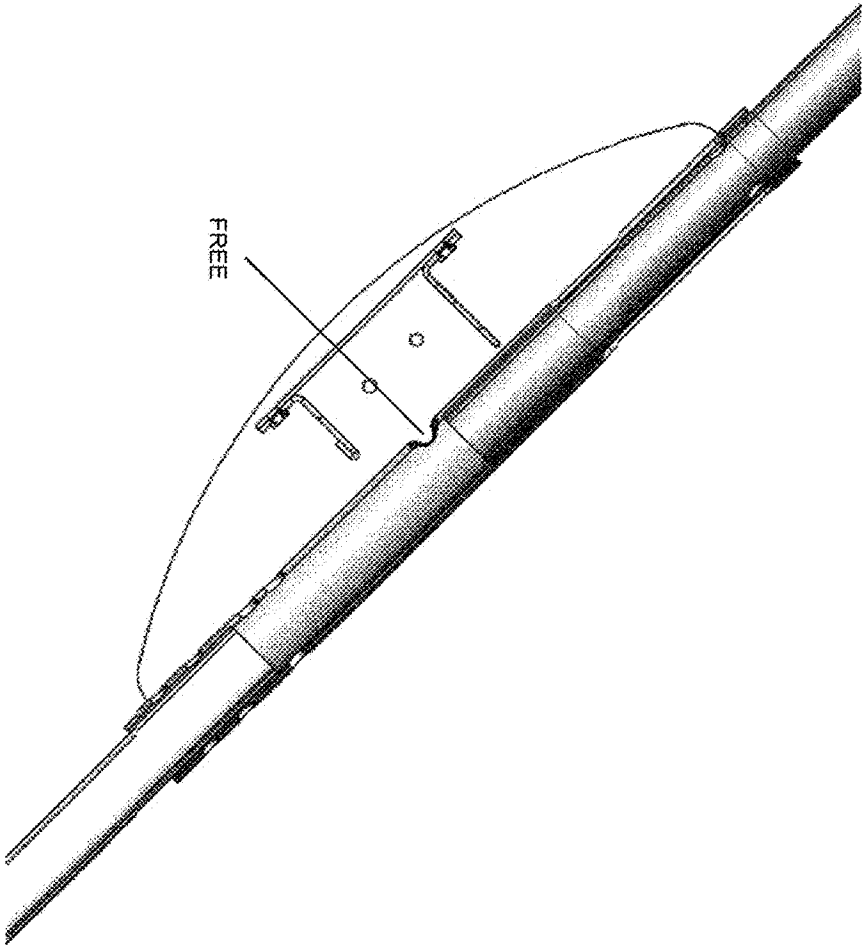
FIGS. 6 and 7 show detailed views of the sliding part of said guiding element in the idle position (FIG. 6) and in the retracted position (FIG. 7), respectively.
Figure 7:
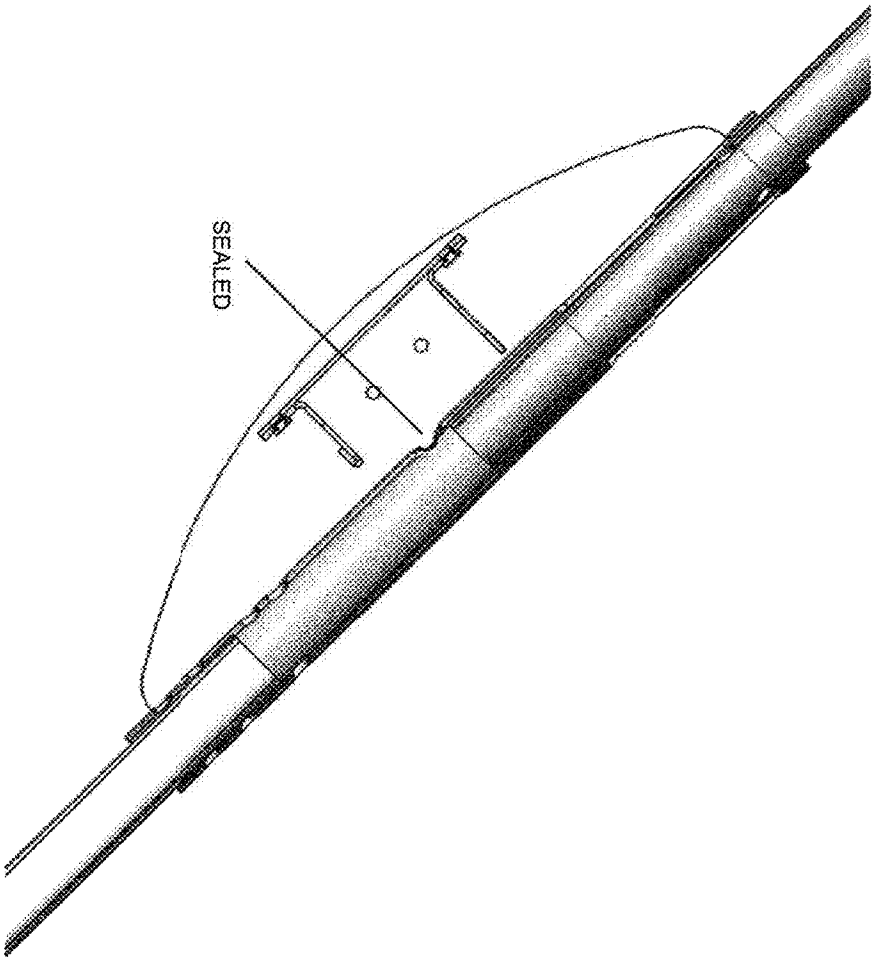

According to an embodiment, as shown in FIGS. 6 and 7, the stationary part has an aperture 790 that is closed off when the telescoping zone is in the retracted position and free when the telescoping zone is in the extended position.

According to another embodiment of the invention, one simple detection means is to provide an aperture 790 in the stationary part 750 that corresponds to an aperture present in the sliding part 745 and which detects a movement of the sliding part 745 relative to the stationary part 750 as soon as they are no longer in phase and thus actuates the switch. FIG. 6 shows the sliding part of said guiding element in the idle or extended position, FIG. 7 showing this sliding part in the retracted position.

The switch 770 very traditionally makes it then possible, by electrical contact, to send a command to the driving motor that allows the latter either to be switched off or to be reversed.

Any other equivalent means may of course be considered and will fall within the scope of the present invention.

Thus in another embodiment, the detection switch comprises an optical part that will move and come into contact with an electrical part 774 as soon as the sliding part 745 begins to move relative to the stationary part 750 of the shaft 740 of the guiding element 70.

The invention claimed is:

1. A urban or industrial vacuum cleaner (1) on a chassis (50) and self-propelled by at least one driving motor, comprising a guiding element in the form of a handlebar (70) with at least a shaft (740), a hand grip (730) and means or elements (710) for attachment to the chassis (50) of the vacuum cleaner (1), said attachment means or elements (710) enabling, by the transmission of the movement applied to the hand grip (730), to steer said vacuum cleaner (1), characterized in that the shaft (740) comprises a telescoping zone with a sliding part (745) able to move (slide) between a first extended position and a second retracted position, with a return spring (780) and at least one switch (770) for detecting the position of the sliding part (745), said switch (770) being able to cause the driving motor of the urban vacuum cleaner to switch off or reverse if the sliding part (745) is in the retracted position.

2. The self-propelled urban or industrial vacuum cleaner (1) according to claim 1, characterized in that the travel of the sliding or telescoping part (745) is of at least 80 mm.

3. The self-propelled urban or industrial vacuum cleaner (1) according to claim 1, characterized in that the return spring (780) is configured so as to return said sliding part (745) of the shaft (740) to the extended position as soon as no force is exerted on the hand grip (730).

4. The self-propelled urban or industrial vacuum cleaner (1) according to claim 1, characterized in that the return spring (780) is configured to be positioned in a retracted position as soon as a force is applied on said hand grip (730) of the handlebar (70).

5. The self-propelled urban or industrial vacuum cleaner (1) according to claim 1, characterized in that the sliding or telescoping part has at least two shaft parts (745, 750) provided with sliding rings (746) through which one shaft part can be inserted in the other and through which the two shaft parts (745, 750) can move relative to one another.

6. The self-propelled urban or industrial vacuum cleaner (1) according to claim 1, characterized in that the length of each of said shaft parts (745, 750) is substantially equivalent to and at least more than half of the total length of the shaft (740).

7. The self-propelled urban or industrial vacuum cleaner (1) according to claim 1, characterized in that the detection switch (770) is able to send a signal as soon as the shaft (740) is no longer in its extended position.

8. The self-propelled urban or industrial vacuum cleaner (1) according to claim 7, wherein the signal is an electrical or optical signal.

9. The self-propelled urban or industrial vacuum cleaner (1) according to claim 1, characterized in that the detection switch (770) comprises a mechanical part (771) that will move and come into contact with an electrical part (774) as soon as the sliding part (745) moves relative to the stationary part (750) of the shaft (740) of the handlebar (70).

10. The self-propelled urban or industrial vacuum cleaner (1) according to claim 1, characterized in that the detection switch comprises an optical part that will move and come into contact with an electrical part (774) as soon as the sliding part (745) moves relative to the stationary part (750) of the shaft (740) of the handlebar (70).

11. The self-propelled urban or industrial vacuum cleaner (1) according to claim 1, characterized in that the travel of the sliding or telescoping part (745) is of at least 100 mm.

12. The self-propelled urban or industrial vacuum cleaner (1) according to claim 1, characterized in that the travel of the sliding or telescoping part (745) is of at least 150 mm.

* * * * *